US005834150A

United States Patent [19]

Brennan et al.

[11] Patent Number: 5,834,150

[45] Date of Patent: Nov. 10, 1998

[54] SOLVENT VAPOR FIXING METHODS AND PROCESS COLOR TONERS FOR USE IN SAME

[75] Inventors: Michael W. Brennan, North Ranch; Arthur S. Diamond, Ventura, both of Calif.

[73] Assignee: Interscience Computer Corporation, Agoura Hills, Calif.

[21] Appl. No.: 514,176

[22] Filed: Aug. 11, 1995

[51] Int. Cl.[6] ..... G03G 9/00

[52] U.S. Cl. ..... 430/110; 430/124

[58] Field of Search ..... 430/110, 124

[56] References Cited

U.S. PATENT DOCUMENTS

| | | | |
|---|---|---|---|
| 3,590,000 | 6/1971 | Palermiti et al. . | |
| 3,681,106 | 8/1972 | Burns et al. . | |
| 3,740,334 | 6/1973 | Jacknow et al. . | |
| 4,066,802 | 1/1978 | Clemens | 430/47 |
| 4,267,556 | 5/1981 | Fotland et al. . | |
| 4,311,723 | 1/1982 | Mugrauer . | |
| 5,014,090 | 5/1991 | Santilli . | |
| 5,305,019 | 4/1994 | Orth et al. . | |
| 5,314,777 | 5/1994 | Watanabe et al. . | |
| 5,318,871 | 6/1994 | Inagaki et al. . | |
| 5,333,042 | 7/1994 | Brennan et al. . | |

OTHER PUBLICATIONS

"Printing With Electrons" by Ben Smith, Byte Magazine, Oct. 1991, McGraw–Hill, Inc., New York.

"Dry Toner Fundamentals, Tutorial II" by Dr. Trevor I. Martin, Imaging Materials Seminar, 12TH Toner & Photoreceptor Conference & Tutorial, Jun. 4 to 7, 1995.

"Toner: Black Powder for an Exploding Market" by Arthur S. Diamond, Sep., 1979, Diamond Research Corporation, Ventura, California.

"Toner Resins: Structure of the U.S. Market Report No. 2286" by Arthur S. Diamond, Mar. 1987, Diamond Research Corporation, Ventura, California.

"Toner in the 90's: The Shape of Things to Come" by Arthur S. Diamond and Lynn S. Ritter, Dataquest Incorporated, 1990. pp. 7–8, 117–120, and 195.

*Primary Examiner*—Mark Chapman

*Attorney, Agent, or Firm*—Lyon & Lyon LLP

[57] ABSTRACT

A solvent vapor fixing method is provided. Novel dry toner formulations for use with the method are also provided. The method and system of the invention may be advantageously utilized in color imaging, security document imaging, and magnetic ink character recognition printing within electrophotographic, electrographic, and magnetographic imaging systems designed for solvent vapor fixing.

10 Claims, 1 Drawing Sheet

SOLVENT VAPOR FIXING METHODS AND PROCESS COLOR TONERS FOR USE IN SAME

FIELD OF THE INVENTION

The present invention relates to dry toners suitable for use in specialized imaging applications. More particularly, this invention relates to dry toners which may advantageously be used in color imaging, security document imaging, magnetic ink character recognition (MICR) printing and other specialized imaging applications within an electrophotographic, electrographic, or magnetographic imaging system and designed for compatibility with solvent vapor fixing. Solvent vapor fixing methods using the dry toners of the invention are also disclosed and claimed.

BACKGROUND OF THE INVENTION

Dry toners are powder substances which are used in electrophotographic, electrographic or magnetographic imaging systems to create visible images on paper, film, vellum, and other substrates. Such dry toners are composed of at least one resin which has been mixed with a colorant. Other additives such as flow promoters and charge control agents may also be added.

The composition may include mixtures or co-polymers of resins in varying amounts selected to provide desired characteristics in the visible image produced. As used in this specification, the term "resin" is synonymous with the terms "toner resin", "toner binder", "binder resin", and "binder" all of which are used somewhat interchangeably in the art of formulating dry toners.

Dry toner can be adhered, i.e., fixed, to a substrate by exposing the toner either to heat and pressure or to radiant heat which softens or liquifies the toner, or to solvent vapors which solvate the toner. Each process causes the toner to become fixed to the substrate. Fixing, as used in this specification, is also commonly referred to as "fusing." (See, e.g., Brennan, et al., U.S. Pat. No. 5,333,042 and concurrently filed application titled "HIGH SPEED PRODUCTION PRINTING SYSTEM EMPLOYING ELECTRON-BEAM IMAGING AND VAPOR FIXING TECHNOLOGY" filed by Michael W. Brennan and Arthur S. Diamond, Ser. No. 08/514,435, the entire disclosures of which are incorporated herein by reference.)

The initial step in a typical electrophotographic, electrographic or magnetographic imaging process is image creation and development. In a typical electrophotographic imaging process, e.g., laser printing, a laser is used to create a latent, electrostatic image on a photoreceptive drum, belt, or other device having a smooth surface capable of retaining a photoconductive layer. The smooth surface of the photoreceptor is first given a blanket, uniform electrostatic charge by means of a high voltage corona device, a lower voltage charging roller or shoe, or other charging element. A laser beam is then swept across the photoreceptor to discharge the potential at selected areas of the surface. The selective discharge is accomplished by modulating the light intensity of the beam as it sweeps or by selectively activating and deactivating the laser by means of appropriate driver electronics. A latent, electrostatic image of the desired shape, style and appearance is thereby formed on the surface.

In a variation of the electrophotographic process, a linear array of light-emitting diodes (LEDs) activated by appropriate switching means may be used to create the image. Alternatively, a liquid crystal shutter (LCS) having liquid crystal cells arranged in matrix form between an elongated quartz exposure lamp and the photoconductor may be employed.

Once a latent, electrostatic image is created by any of the aforementioned charging and exposure means, a corresponding visible image is developed, typically by applying an electrostatically charged toner to the photoconductive layer using a magnetic brush, cascade, powder cloud, or other developer system commonly known in the art. The electrophotographic process is well known in the art as exemplified by Mugrauer, U.S. Pat. No. 4,311,723 and Brennan, et al., U.S. Pat. No. 5,333,042, the entire disclosures of which are incorporated herein by reference.

In contrast to electrophotographic printing systems, electrographic printers, which include dielectric imaging devices, do not use light to create a latent, electrostatic image. The dielectric imaging devices used in such systems commonly include nib-type printheads or electron beam devices. Electrographic printing systems are typically used in wide format printer/plotters. Nib-type printheads form an image of the desired shape and appearance using a linear array of styli, or nibs, which selectively deposit an electrostatic charge directly upon a receiving substrate. Once the image is formed, toner development follows.

In electron-beam imaging, formerly known as ionography or ion-deposition imaging, the image is created using an electron beam controlled by appropriate driver electronics. Electrons are deposited onto the insulating surface of a rotating drum bearing a dielectric coating, such as aluminum oxide, thereby forming a latent image. After the latent image is formed, the image is developed in a manner similar to that performed in electrophotographic printing systems. Electrographic processes are well known in the art. See, for example, Fotland, et al., U.S. Pat. No. 4,267,556, and concurrently filed application titled "HIGH SPEED PRODUCTION PRINTING SYSTEM EMPLOYING ELECTRON-BEAM IMAGING AND VAPOR FIXING TECHNOLOGY" filed by Michael W. Brennan and Arthur S. Diamond, Ser. No. 08/514.435, the entire disclosures of which are incorporated herein by reference.

Image creation and development is achieved in magnetographic printers in a manner similar to electrographic printers, except that the latent image has a magnetized rather than electrostatic charge. The latent magnetic image is created using magnetic recording elements. Image development is typically achieved in magnetographic systems by applying toners having ferromagnetic pigments which are readily attracted to the latent, magnetic image. Magnetographic processes are well known in the art. See, for example, Orth, et al., U.S. Pat. No. 5,305,019, the entire disclosure of which is incorporated herein by reference.

After the image development step, electrophotographic, electrographic and magnetographic systems undertake to fix the image to a substrate. In conventional laser printers, for example, fixation of the toner to the substrate is accomplished by exposure to heat and pressure—a process known as hot roll fixing. In hot roll fixing, the substrate having either electrostatically or magnetically attached toner is typically passed between two rollers. One roller is an internally heated roller and the other is a conforming pressure roller. The rollers press the toner against the substrate, while the heat transferred to the substrate and the toner causes the toner to melt and become adhered to the substrate.

Hot roll fixing, using a combination of heat and pressure, has several disadvantages. First, as a result of contact between the toner and a roller, there is an attendant risk that the toner may be picked-off the substrate prior to fixing thereon and become adhesively attached to the roller, a process known as cold offset. This condition can occur if the surface temperature of the heated roller is too low. Second, there is a risk that the toner will temporarily adhere to the roller and create multiple ghost images on subsequently printed substrates, a condition known as hot offset. To avoid hot offset, some imaging systems apply a thin layer of silicone oil to the contact roller. The silicone oil acts as a release agent, preventing the toner from adhering to the roller.

A third disadvantage is that hot roll fixing is unable to achieve the high speeds required, in some cases well in excess of 100 feet per minute, which are required for economically efficient large-scale printing applications. Fourth, duplexing, i.e., developing images on both sides of the substrate, is difficult to accomplish in a single pass using hot roll systems.

Some laser printers employ radiant heat to fix the toner to the substrate in a process known as radiant heat fixing or flash fixing. In radiant heat fixing, high intensity flash lamps are typically used as the heat source. Because the substrate surface does not come into contact with any roller or conductive heat element, radiant heat fixing avoids image offset problems. Using radiant heat fixing, it is also possible to achieve duplexing in a single fixing cycle. However, radiant heat fixing is not as energy efficient with respect to heat transfer as the hot roll fixing method. This drawback becomes especially important in terms of cost and energy consumption with the increased printing speeds that are generally desired for efficient high-speed printing. Radiant heat fixing also presents a safety hazard, as a paper jam or web break can cause the substrate stalled under the flash lamp to ignite.

A further disadvantage common to the conventional hot roll and radiant thermal fixing methods is that they require toner formulations that are extremely temperature sensitive. Thermal fixing systems normally require toners that have a low glass transition temperature, generally in the range of about 55° C. to 60° C. As a result, these toners may undesirably tend to cake and agglomerate when subjected to temperatures commonly encountered during handling, storage and transportation. Agglomeration and caking is also a problem in the automated filling machines used to bottle or package these heat sensitive toner powders. Some filling machines act upon the toner with stirring bars which can cause the toner to be caught in moving bearings or trapped between moving surfaces where frictional forces can generate sufficient heat to raise the trapped toner to its glass transition temperature, thereby producing agglomerates, lumps and flakes of toner. These undesirable particles can, in turn, result in spurious deposits such as spots and streaks on the finished print.

A final disadvantage common to thermal fixing methods has arisen in certain specialized applications, particularly in security document imaging and magnetic ink character recognition (MICR) printing, within electrophotographic, electrographic and many magnetographic imaging systems. In those applications, toner flow is often insufficient to "wick" the toner into the fibrous mat of the substrate to the extent that it is desirably impossible to remove the toner without destroying the substrate. Such permanency of adhesion is advantageous in security document and MICR applications, as it prevents image removal by erasure, flaking or other means which helps prevent tampering and counterfeiting. In MICR applications, poorly adhered toner may chip or flake-off prior to or during the magnetic reading process, presenting the possibility of reading errors and increasing the frequency of read head cleaning.

Another type of laser printing system employs solvent vapors to fix toner to a substrate—a process known as vapor fixing. See Brennan, et al., U.S. Pat. No. 5,333,042. In vapor fixing, a solvent chemical vapor, i.e. a fixing agent, is vaporized and placed in contact with the electrostatically or magnetically attached toner, thereby solvating the toner and causing it to be fixed to the substrate. The term "solvating" or "solvates" as used herein refers to the fixing agent's interaction with the toner whereby the toner is partially or completely dissolved in or solubilized by the fixing agent, and "solvatable" refers to the capability of being solvated.

Presently employed vapor fixing techniques generally use vapors of an environmentally acceptable halogenated hydrocarbon, hereinafter referred to as "HCFC" such as 1,1-dichloro-1-fluoroethane, commonly known as HCFC-141b and sold under the name (GENETRON 2000) by Allied-Signal, Inc., Morristown, N.J., as the solvent. See Brennan, et al., U.S. Pat. No. 5,333,042. Vapor fixing methods have also been developed that are compatible with electron-beam imaging technology. See concurrently filed application titled "HIGH SPEED PRODUCTION PRINTING SYSTEM EMPLOYING ELECTRON-BEAM IMAGING AND VAPOR FIXING TECHNOLOGY" filed by Michael W. Brennan and Arthur S. Diamond, Ser. No. 08/514,435.

In vapor fixing, the substrate surface having the toner does not come into contact with any hot roller or conductive heat element. Thus, vapor fixing is not subject to hot and cold offset. Moreover, vapor fixing allows for single cycle duplexing because of the absence of hot rollers or conductive heat elements in contact with the toned image portions of the substrate.

Vapor fixing is known to fix toner having carbon black colorant to substrates at speeds of more than 100 feet per minute, and since it does not require heat, has proven both energy efficient and cost effective for large-scale printing operations (See Brennan, et al., U.S. Pat. No. 5,333,042 and concurrently filed application titled "HIGH SPEED PRODUCTION PRINTING SYSTEM EMPLOYING ELECTRON-BEAM IMAGING AND VAPOR FIXING TECHNOLOGY" filed by Michael W. Brennan and Arthur S. Diamond, Ser. No. 08/514,435.

Finally, vapor fixing systems are designed for solvent recovery and solvent recycling within the vapor module itself. The recycling feature, coupled with the energy savings, makes vapor fixing the most economical and ecologically friendly high-speed fixing process.

While vapor fixing is a well-known alternative to the aforementioned conventional fixing methods, prior to the present invention, it is believed that vapor fixing has only been used successfully in monochrome printing applications using black colorants. Until the present invention, vapor fixing, for reasons which will become apparent, has not been used in color imaging, and more particularly for using color in security document imaging, MICR printing, and other specialized applications.

A primary reason that vapor fixing has not advanced into the field of color imaging is that known process color toners are not well-suited to vapor fixing. Color imaging can be divided into two main categories: (1) line, highlight, or spot imaging, wherein a permanent toned image of a color other than black is produced using toner particles of a single color; and (2) process, or "near photographic" color imaging, wherein a permanent toned image is produced by selectively blending or mixing toner particles of two or more primary colors.

Process color imaging involves the selective blending or mixing of monochrome toners matched in hue, saturation (chroma) and brightness to attain a permanent toned image of any desired color. Process color toners function as true subtractive primaries in accordance with one of the standard color gamuts, such as the well-known specification web offset printing (SWOP) or the Pantone color standards. By selectively blending process color toners, typically cyan (minus red), magenta (minus green) and yellow (minus blue), it is possible to produce images of any color in the rainbow, and thereby generate multicolor images having near-photographic quality.

Known toners adapted for use in process color imaging, i.e., those functioning as true subtractive primaries, are composed of colorants embedded in polyester resins. Polyester resins, such as polyethylene terephthalate, propoxylated bisphenol-A fumarate and other glycol acid resins, have been selected for process color toners generally because they have excellent pigment (colorant) dispersion properties. Thus, they minimize interfacial boundaries between the colorant and the resin binder. Interfacial boundaries cause internal scattering of incident light with a toner layer and thereby desaturate the resultant image color, that is, reduce its color purity.

One property of polyester resins which minimizes interfacial boundaries is good pigment wetting during image fixing. Another property is low melt viscosity, i.e., high melt index. Polyester resins typically exhibit a low melt viscosity, which enables rapid flow under the application of heat. When subject to thermal fixing, this rapid flow characteristic allows the toner particles containing process color colorants to properly coalesce and form an essentially transparent layer of toner of the appropriate hue, brightness and chroma. This thorough mixing of the subtractive primary toner colorant particles facilitates intimate blending to minimize interfacial boundaries.

In addition to minimizing interfacial boundaries, the low melt viscosity of polyester resins aids in the formation of an image of uniform surface smoothness and gloss, which avoids the problem of surface light scattering and thereby further enhances color brilliance.

Polyester resins have also been chosen as the preferred toner resin for process color toners because such resins can be clear and colorless, or "water-white." Many other resins tend to be cloudy, translucent, or semi-opaque when viewed in the pure state, or to have a yellow cast. All of these latter properties are undesirable for a process color toner resin because they detract from the purity of the color by desaturation.

Despite these advantages, prior to the present invention, known process color toners were not well-suited to solvent vapor fixing methods. Particularly, the polyester resins used in known process color toners are not effectively solvated in the halogenated hydrocarbon vapors used in solvent vapor fixing, and are not known to become acceptably adhesive or tacky when exposed to such vapors in a printing system. A further disadvantage associated with using known process color toners is their poor storage and handling characteristics. Because of their high melt index, the known polyester-resin-based color toners tend to cake and agglomerate at elevated handling, shipping and storage temperatures.

Accordingly, although solvent vapor fixing is the most energy efficient and cost effective path to high speed imaging, known process color toners are not well-adapted to solvent vapor fixing. There remains a need to extend the advantages of solvent vapor fixing into the specialized fields of color imaging, MICR printing and secure document imaging. In the case of process color printing, there is a need for novel process color toner formulations which are readily solvated by environmentally acceptable vapor fixing solvents, and which have high glass transition temperatures. In the case of MICR and security document imaging, there is a need for a toner and a fixing method which allows the toner to become so thoroughly bonded to the substrate that it is impossible for the toner to be removed from the substrate without destroying the substrate.

The toners and methods of this invention provide a means for achieving high speed color imaging and for more efficient and effective MICR and secure document printing without the disadvantages associated with presently available color toner formulations.

SUMMARY OF THE INVENTION

The present invention advantageously provides for the use of solvent vapor fixing to achieve results which are not achievable by present thermal fixing or vapor fixing methods, but which are essential to accomplish energy efficient, high speed fixing desirable in certain specialized dry toner applications such as color printing, secure document printing, and magnetic ink character recognition (MICR) printing.

In one aspect of the invention, novel process color toner formulations suitable for solvent vapor fixing have improved handling and storage characteristics. The process color toners of the invention include as a primary resin one or more resins which are readily solvated by halogenated hydrocarbon vapors. These primary resins, which may be used alone or in combination with secondary resins and additives, include styrene-methyl methacrylate, styrene-butyl methacrylate, styrene-ethylhexyl methacrylate, polystyrene, styrene-butadiene, co-polymers thereof, and mixtures thereof. Other examples of primary resins are polyamide polymers and co-polymers such as (MACROMELT 6040) sold by Henkel, Kankakee, Ill., and (KEMAMIDE B) sold by Witco Corporation of Greenwich, Conn. Certain low molecular weight, minimally branched polyester resins that are HCFC solvatable may also be used as a primary resin such as (RUCOTE 102), a neopentyl glycol terephthalate polyester manufactured by Ruco Polymer Corporation, Hicksville, N.Y.

In another aspect of the invention, the process color toners of the invention include secondary resins, such as polyesters, and styrene-based, as well as non-styrene-based polyamide or polyester resin materials as well. The measured addition of one or more secondary toner resins to the primary resin prior to compounding of the process color toners of the invention allows for control over the smoothness, degree of gloss and degree of adhesion of the fixed color image to the substrate.

Also, in general, as the ratio of primary toner resin, e.g., styrene-butylmethacrylate, to an effectively HCFC-insolvatable secondary resin, e.g., certain higher molecular weight, highly-branched polyesters, is increased, image gloss and adhesion are also increased. Increasing the solvent vapor density in the fixing chamber also increases adhesion as well as the quality of the final image.

In a further aspect of the invention, one or more squeeze rollers (also called finishing rollers) are applied to the toned image immediately after the toned image is exposed to the solvent vapor and while the image still retains a portion of the solvent. The measured application of the squeeze rollers provides further control over the degree of adhesion of the image to the substrate. When desired, the rollers can provide for permanent image adhesion to the fibers of the substrate.

Such permanent adhesion is particularly desirable in MICR printing and security document printing. In the case of process color imaging, the rollers can be employed selectively to manipulate the level of coalescence and thereby achieve the desired level of image gloss.

The novel process color toner formulations of the invention allow for the extension of the economic and environmental benefits of vapor fixing to the field of process color imaging according to the methods of the invention.

DETAILED DESCRIPTION OF PREFERRED EMBODIMENTS

Figure 1:
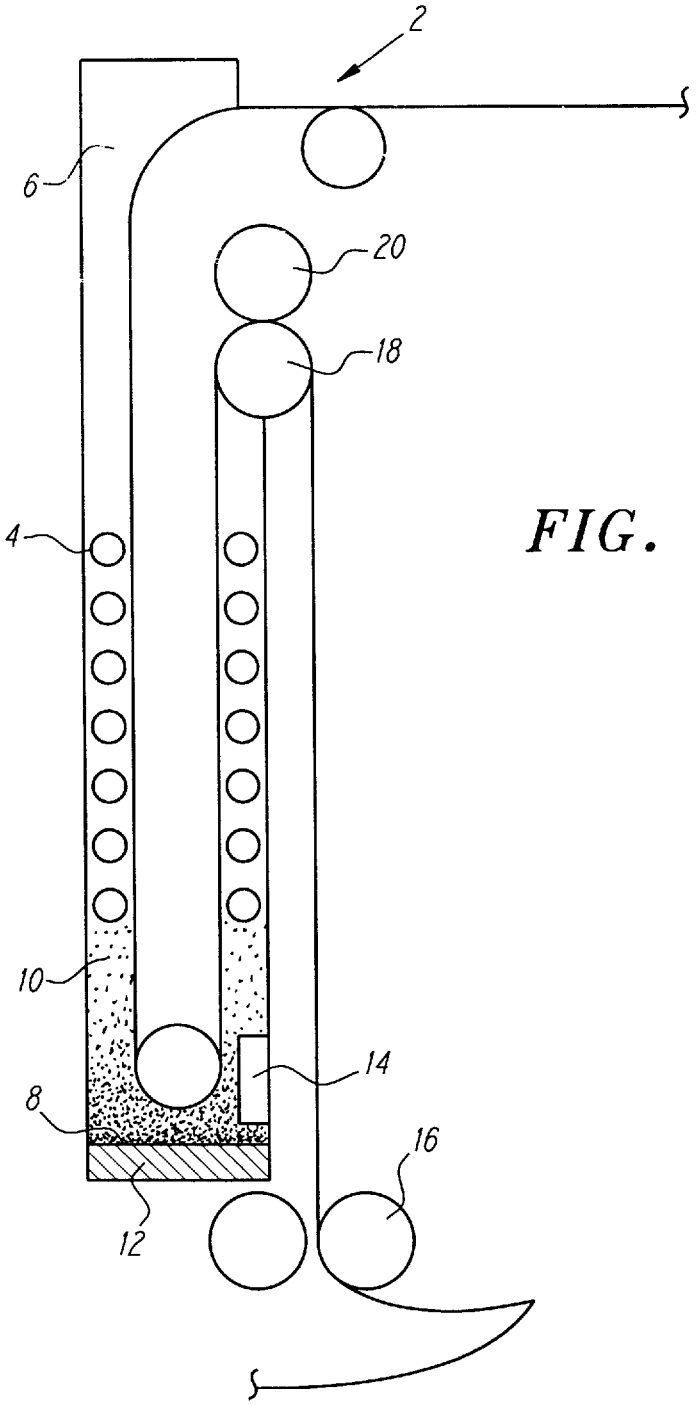
FIG. 1 illustrates a schematic cross-sectional view of a vapor fixing station of a high-speed printing system.

Toner resins are well known in the art of toner manufacturing and include a variety of homopolymers and copolymers based upon styrene, styrene-acrylic, styrene-butadiene, and polyamide resins, as well as modified wood rosins and polyester compounds. In accordance with a preferred embodiment of the process color toner of the invention, a styrene-based toner resin is selected to be mixed with suitable colorants such as dyes or pigments. (Pigments are insoluble colored particles and dyes can be soluble or insoluble particles.) For line color applications, the colorant might be any one of a variety of hues created by a single pigment or dye or by a mixture thereof. For process color applications, at least three different toners are used, cyan, magenta, and yellow, respectively, known in the art as the substractive primaries. Other additives, such as charge control agents and flow promoters commonly known in the art may also be added. The selected ingredients are thoroughly mixed in, for example, a hot compounding device such as a Banbury mixer, a compounding extruder or a two-roll mill. The styrene-based toner resin of the invention may be selected from the group of resins that includes homopolymers and co-polymers of styrene-methyl methacrylate, styrene-butyl methacrylate, styrene-ethylhexyl methacrylate, polystyrene, and styrene-butadiene, or mixtures thereof.

In other embodiments of the invention, non-styrene-based resins which are solvated by the vapor fixing agent during the vapor fixing process may be selected as the primary resin. Examples of such other primary resins are polyamide polymers and co-polymers such as (MACROMELT 6040) and (KEMAMIDE B) and certain lower molecular weight and minimally-branched polyesters such as (RUCOTE 102) that are effectively HCFC solvatable.

The selected ingredients of the process color toner of the invention are mixed and melted together to form a homogeneous mass typically of taffy-like consistency. The molten mass is then sheeted out using a two-roll mill or is stranded through a stranding dye at the exit end of an extruder.

The sheets or strands are then air-cooled or water-cooled using an endless cooling belt, a chill roll flaker, or other cooling system, and then broken into relatively large fragments by a coarse crushing device. The fragments are next granulated into particles usually about one-eighth of an inch in diameter, commonly known as raw feed. The raw feed is fed into a fine grinding device such as a fluid energy mill, commonly known as a jet pulverizer, jet mill, or micronizer. An air-swept hammer mill can also be used in this pulverizing step.

The product of this fine grinding operation is next classified to remove excessively coarse particles, typically those above 20 microns in size, and exceedingly fine particles, typically those less than 5 microns in size. Particle size classification may be accomplished internally during the fine grinding step, or may be performed externally in a separate classification unit. The average diameter of the finished toner particles may range from 5 to 20 micrometers (microns) to suit most imaging applications. The product of the fine grinding and classifying operations is a finished color toner of the invention.

Alternatively, the process color toner of the invention may be prepared by mixing or dispersing the selected resin or resins, along with the process color colorants and other additives, with a suitable solvent, such as methylene chloride, or toluene, in a stirred or agitated vessel. The solvent and resin mixture may be spray-dried, producing, if necessary, extremely small, fine-sized, toner particles such as are used in the current generation of toner-based laser printers and other imaging systems presently known.

The above melt-mixing and solvent spray drying methods are just two examples of process color toner production. Other methods for preparing the process color toners of the invention will be readily apparent to those skilled in the art having the teachings of the specification in mind.

In another preferred embodiment of the process color toner of the invention, the primary resin is mixed with one or more secondary resins and suitable colorants of a process color. Other additives may also be added to the mixture. Secondary non-styrene-based resins may be selected from the non-styrene-based primary resin materials and may also be selected from the effectively HCFC-insolvatable polyester resins as well.

Toners used in MICR and security document-type imaging applications in accordance with the vapor fixing methods of the invention can be produced by any of the methods identified in this specification by mixing a primary resin, and a secondary resin if desired, with appropriate colorants of non-process colors, and other additives in accordance with the teachings of the specification. One additive contemplated for the MICR application toners used with the vapor fixing methods of the invention is a ferromagnetic pigment such as iron oxide or ferrite.

A preferred embodiment of the method of the invention will now be described with reference to FIG. 1 (FIG. 1). FIG. 1 shows a schematic cross-section of the vapor fixing station of a Siemens Nixdorf 2200 Laser Printing System which is modified to illustrate the embodiment of methods of the present invention that employ squeeze rollers 18 and 20. The operation and structure of the Model 2200 and the laser printing process it employs are described in detail in Brennan, et al., U.S. Pat. No. 5,333,042 and the references incorporated therein which are also incorporated herein by reference, and in Mugrauer U.S. Pat. No. 4,311,723. (Note that the vapor fixing process described herein is referred to as a "cold fusion" process in the '042 patent. Either term is acceptable and the terms are interchangeable.)

Referring to FIG. 1, a vapor fixing station 2 includes a chilled air interface that is developed by a set of condensing coils 4 located within a cavity 6. The interface generally confines a vapor bath 8 residing in the cavity 6 to a fixing chamber 10. In the methods of the invention the vapor bath 8 includes vapors of a solvent suitable for solvating the process color toners of the invention. In embodiments of the method of the invention employing non-process color toners (e.g. in the production of MICR and security documents) the solvent selected will be suitable for solvating those toners in the printing processes employed in their production.

A halogenated hydrocarbon such as 1,1 dichloro-1-fluoroethane may be used in preferred embodiments of the method of the invention as taught in Brennan, et al., U.S. Pat. No. 5,333,042. Many other halogenated hydrocarbons suitable for use in the method of the invention are described in the Brennan, et al., '042 patent and the references incorporated therein.

The vapor bath 8 is generated by a thermo-resistor controlled hot plate 12, which boils droplets of the selected solvent as the solvent enters the fixing chamber 10 and contacts the hot plate 12. The flow of solvent droplets into the fixing chamber 10 is regulated by an ultrasonic sensor 14, which measures the impenetrability of sound waves through the vapor bath 8, resulting in the introduction of droplets of the solvent into the fixing chamber 10 in quantities necessary to maintain a preselected vapor density of the bath 8.

Image fixing is effected by transporting a substrate, having toner, which is held to the substrate in the desired image pattern by a charge differential between the toner and the substrate, or alternatively held as a result of mechanical pressure or a combination thereof, through the solvent vapor bath 8. A continuous web feed system is shown in FIG. 1, although one of skill in the art of printer design could readily configure a vapor fixing station which would accept and process cut substrate sheets. The solvent solvates the toner particles causing them to become fixed to the substrate as they pass through the vapor bath 8 and exit the vapor fixing station 2. Thereafter, the substrate passes through a set of exit rollers 16 and onto a form stacker or other collection device (not shown).

In another preferred embodiment of the vapor fixing method of the invention, squeeze rollers, 18 and 20 are positioned at the exit of the vapor fixing chamber 10 and aid in the toner fixing step. Squeeze rollers 18 and 20 may be molded rubber, silicone, or other compressible material on a steel or aluminum core and are preferably adjustable. However those skilled in the art will readily be able to select rollers of appropriate composition and hardness to accomplish the method of the invention described herein.

Referring to FIG. 1, toner fixing begins when a substrate having toner in the desired image pattern is transported through the solvent vapor bath 8. In embodiments of the invention employing squeeze rollers 18 and 20, the parameters of the process are selected such that when the toner particles pass through the nip of squeeze rollers 18 and 20, they retain entrained, condensed solvent. Squeeze rollers 18 and 20 are selected to apply preselected degrees of pressure and embossing upon the toner particles and substrate whereby the solvated toner is further driven into the substrate thereby increasing fixation of the toner particles to the substrate. Desired image surface characteristics, e.g., image smoothness and gloss can also be achieved by manipulating nip pressure. Where a process color toner of the invention is used, this toner fixation step is especially useful as it can force further coalescence of the individual toner particles to ensure good image transparency, color brilliance and the removal of resin/colorant interfacial barriers that can cause light scattering.

Among the parameters which may be adjusted in embodiments of the invention employing squeeze rollers for a selected toner and solvent is the residence time of the toner particles after they enter the vapor bath 8 and until they enter the nip of squeeze rollers 18 and 20. The density of the vapor bath may also be adjusted. Various toner/solvent combinations will require adjustments in residence time, vapor density and squeeze roller pressure to achieve the desired results. These adjustments may readily be determined by those practicing the method of this embodiment of the invention. Any problems of image offset or toner adhesion to the squeeze rollers may be overcome by methods well known in the art such as the use of silicon release agents and the like.

Experiments were carried out to demonstrate that the present invention provides process color toner formulations for solvent vapor fixing which afford control over the gloss and permanency of the toned image. Four experimental toners, cyan in color, were prepared and individually tested. In each test, the toner was applied to a sheet of paper using a cotton swab. The toned sheet was then passed directly through the fixing station of a Siemens Nixdorf Model 2200 laser printing system, wherein vapors of 1,1 dichloro-1-fluoroethane, i.e. HCFC-141*b* or (GENETRON 2000) were resident. The residence time of the sheet in the fixing chamber for each test performed was held constant. The density of the vapor cloud, as measured by the propagation time of an ultrasonic pulse transmitted from the ultrasonic sensor along a fixed path length and reflected back to the ultrasonic sensor was also held constant.

Table 1 identifies each of the four toners with respect to resin composition and fixation results. The toners were prepared by Color Image, Inc., 2972 Pacific Drive, Norcross, Ga. The inventors specified the polyester/styrene-acrylic resins and the cyan colorant. It is believed that Color Image added flow promoter and charge control agents as is customary in the industry. The exact additives are unknown to the inventors and are believed to be proprietary to Color Image. However, such additives are well-known in the art. For example, hydrophobic silica powders, such as (AEROSIL R-972), available from Degussa Corporation, Teterboro, N.J., and fluoropolymer powders, such as (KYNAR 461) a polyvinylidene fluoride available from Elf. Atochem, Pittsburgh, Pa., are well-known flow promoters and nigrosine dyes and acid-treated carbon black pigments are well-known negative charge control agents.

Each toner was tested on plain bond paper (register bond, 18–20 lb.), and one of the toners was also tested on gloss coated paper (publication grade, 80–100 lb.). As the first column of Table 1 indicates, the toner resin composition was varied from 100% polyester, which was shown to be effectively insolvatable in HCFC-141*b* as measured by adherence, to 100% styrene-acrylic, which proved to be sufficiently solvated to yield strong toner adherence to the paper.

Post-fixing toner adherence to the paper was measured qualitatively by erasability with an ordinary pencil eraser using normal hand applied pressure as would be ordinarily used in erasing. A rating of poor was assigned where the toner, upon visual inspection, was essentially completely removed by the pencil eraser. A rating of excellent was assigned where the toner was not visibly removed at all. Fair and good ratings were assigned to toners exhibiting intermediate levels of erasability, wherein a good rating indicated a higher degree of permanency than a fair rating. Surface appearance was determined by visual inspection. With plain bond paper the 100% styrene-acrylic based toner appeared to be fixed into the paper fibers rather than only onto the surface of the paper.

TABLE 1

VAPOR FIXING TEST RESULTS

| RESIN COMPOSITION OF TONER | PAPER TYPE | TONER ADHERENCE | SURFACE APPEARANCE |
|---|---|---|---|
| 100% Polyester | Plain Bond | Poor | Matte |
| 75% Polyester<br>25% Styrene-Acrylic | Plain Bond | Fair | Dull |
| 50% Polyester<br>50% Styrene-Acrylic | Plain Bond | Good | Dull |
| 100% Styrene-Acrylic | Plain Bond | Good | Dull |
| 100% Styrene-Acrylic | Gloss Coated | Good | Glossy |

An additional test was performed on the 100% styrene-acrylic toner in which the density of the HCFC-141*b* vapor cloud in the fixing chamber was increased as measured by an increase in the propagation time of the ultrasonic pulse from 67 microseconds to 80 microseconds. The residence time of the paper in the fixing chamber was the same as in the other tests. At the higher vapor cloud density, the adherence of the 100% styrene-acrylic toner achieved a rating of excellent on both bond and gloss coated paper. The toner particles appeared to be fully coalesced and intimately mixed, thereby yielding better, more durable print quality.

As will be apparent to those skilled in the art, the composition of the color process toner of the invention and the parameters of the methods of fixing toner to a substrate may be varied considerably without departing from the scope of the invention. Testing of the parameters selected within the scope of the invention may be readily accomplished by performing test runs on the printers with which the invention will be used.

While the present invention has been described in connection with the presently preferred embodiments, it will be apparent to those skilled in the art, after having the benefit of the disclosure set forth herein, that modifications may be made, additional chemicals may be added, additional steps may be performed, and improvements may be incorporated without departing from the spirit and scope of the present invention. The present invention is not limited to the specific examples described herein, but is only limited by the scope of the claims set forth below.

What is claimed is:

1. A dry toner suitable for use in solvent vapor fixing comprising:

one or more primary resins that are capable of being solvated by a hydrochlorofluorocarbon;

one or more secondary resins; and a colorant of a process color, where said secondary resins are effectively incapable of being solvated by said hydrochlorofluorocarbon during solvent vapor fixing.

2. The dry toner according to claim 1 wherein said one or more primary resins include a styrene-based resin.

3. The dry toner according to claim 2 wherein said styrene-based resin is selected from the group consisting of:

styrene-methyl methacrylate;

styrene-butyl methacrylate;

styrene-ethylhexyl methacrylate;

polystyrene;

styrene-butadiene; and copolymers thereof.

4. The dry toner according to claim 1 wherein said one or more primary resins include a polyester resin solvatable in said hydrochlorofluorocarbon.

5. The dry toner according to claim 1 wherein said one or more primary resins are selected from the group consisting of polyamide polymers and copolymers.

6. The dry toner according to claim 1 wherein said secondary resins are non-styrene-based resins.

7. The dry toner according to claim 1 wherein said secondary resins consist essentially of polyester resins that are effectively incapable of being solvated by a hydrochlorofluorocarbon.

8. The dry toner according to claim 1 wherein said secondary resins are selected from the group consisting of polyamide polymers and copolymers.

9. The dry toner according to claim 1 wherein said secondary resins are colorless.

10. The dry toner according to any of claims 1 through 5 and 6 through 9 wherein said hydrochlorofluorocarbon is 1,1 dichloro-1-fluoroethane.

* * * * *